US007667664B2

(12) United States Patent
Tao

(10) Patent No.: US 7,667,664 B2
(45) Date of Patent: Feb. 23, 2010

(54) EMBEDDED ANTENNA

(75) Inventor: Wen-Szu Tao, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 66 days.

(21) Appl. No.: 11/970,566

(22) Filed: Jan. 8, 2008

(65) Prior Publication Data

US 2008/0316141 A1 Dec. 25, 2008

(30) Foreign Application Priority Data

Jun. 21, 2007 (TW) ..... 96122371 A

(51) Int. Cl.
*H01Q 1/40* (2006.01)
*H01Q 1/24* (2006.01)

(52) U.S. Cl. ..... 343/873; 343/872; 343/702; 343/700 MS

(58) Field of Classification Search ..... None
See application file for complete search history.

(56) References Cited

U.S. PATENT DOCUMENTS

2006/0262016 A1* 11/2006 Hung et al. ..... 343/702
2007/0040750 A1* 2/2007 Tai et al. ..... 343/700 MS
2007/0103370 A1* 5/2007 Hung et al. ..... 343/700 MS
2007/0120753 A1* 5/2007 Hung et al. ..... 343/702
2007/0132646 A1* 6/2007 Hung et al. ..... 343/700 MS
2007/0146216 A1* 6/2007 Wang et al. ..... 343/702
2008/0030407 A1* 2/2008 Hung et al. ..... 343/700 MS

* cited by examiner

*Primary Examiner*—Trinh V Dinh
(74) *Attorney, Agent, or Firm*—Muncy, Geissler, Olds & Lowe, PLLC

(57) ABSTRACT

The present invention provides an embedded antenna. It is to form meanders on a radiating element of the embedded antenna for dividing the resonant length of the radiating element into several short resonant length to extend the bandwidth of the radiating element. It is also to form meanders on the radiating element to extend the resonant length. This design can minimize the size of the embedded antenna and achieve the same as performance of a larger size antenna.

16 Claims, 9 Drawing Sheets

EMBEDDED ANTENNA

FIELD OF THE INVENTION

This invention relates to designs for antenna structures, and more particularly to embedded antennas.

DESCRIPTION OF THE PRIOR ART

Currently, the communication technology in a great development, many information processing systems, in particular to, laptops, personal digital assistants (PDA), cellular mobile phones and portable devices for game/entertainment, typically employs wireless communication peripherals to communicate with external world without the wired connection.

A conventional personal computer or laptop must has an antenna to transmit or receive a radio frequency (RF) signal for performing wireless communication if it desires to communicate with external devices by wireless network connectivity.

A wireless communication device generally includes one or more antennas which transmit or receive RF signals. The specific antennas disposed in the device may be customized to adapt various wireless communication applications. Antenna design is primarily determined by some factor, e.g. communication protocol, frequency range, data flux, distance, power level, quality of service (Qos) and other factors.

FIG. 1 is a diagram illustrating a conventional laptop 10. The laptop 10 includes a host 12 and a display 14. An antenna 16 is mounted on the host 12 to transmit or receive RF signal. The disadvantage of this configuration is that the antenna 16 is disposed outside the host 12, the size is huge and the antenna 16 is likely to be damage by external environment or force.

In another conventional design, an antenna 18 is embedded within the housing of the laptop 10, and covered within the laptop 10 to reduce possibility of damage. The space among the components within the laptop is very tight to achieve the purpose of minimizing its size for portability. The performance of an embedded antenna is readily interference by external environment, such as, the electromagnetic field caused by the circuit in a laptop can affect the performance. In addition, each type laptop has different configuration, and an improper configuration can affect the orientation of an embedded antenna within the laptop so that the performance will be downgrade. Moreover, each laptop with different configuration must customize antennas therein to achieve the optimum wireless connectivity performance.

However, the customized antenna design may cause a high manufacture cost. The current antenna designs must allow for various applications in a different communication protocol, such as AMPS (824-894 MHz), IEEE 802.11b/g (2.4-2.5 GHz), IEEE 802.11a (4.9-5.85 GHz), and other case with specific frequency bands. Therefore, there is a need to improve the operation bandwidth and the efficiency of an antenna for accommodating various devices with different configurations and communication protocols.

SUMMARY OF THE INVENTION

The object of the present invention is to provide a multiband PIFA antenna that has a specific design to extend the low and high band and to improve the performance thereof so that it can be broadly operated in various protocols and configurations In one aspect of the present invention, the antenna includes specific grooves (meanders) on a radiating element of the embedded antenna thereby dividing the resonant length of the embedded antenna into multiple resonant lengths for extend the frequency range of the embedded antenna. Additionally, a wide meander is formed on the radiating element to extend the resonant length, which reduces the size of the embedded antenna and achieves a better frequency range and performance than the conventional one with same sizes.

For the aforementioned, the present invention discloses an embedded antenna, comprising: a grounding element having a first ground plane and a second ground plane; a first radiating element connected to the grounding element, operating at a first frequency band and having a fist resonant length, wherein a first meander is formed on a plane of the first radiating element, wherein the radiating element has a first plane stretched from the second grounding element; a second radiating element connected to the grounding element, operating at a second frequency band and having a second resonant length; and a feeding point connected to the first radiating element and the second radiating element.

Moreover, the present invention also discloses an embedded antenna, comprising: a grounding element having a first ground plane and a second ground plane; a first radiating element connected to the grounding element, operating at a first frequency band and having a fist resonant length, wherein a meander is formed on a plane of the first radiating element, wherein the radiating element has a first plane stretched from the second grounding element; a second radiating element connected to the grounding element, operating at a second frequency band and having a second resonant length, wherein the second radiating element has a second meander thereby extending a resonant length of the second radiating element; and a feeding point connected to the first radiating element and second radiating element.

These and other aspects, objects, features and advantages of the present invention will be described or become apparent from the following detailed description of preferred embodiments, which is to be read in connection with the accompanying drawing.

BRIEF DESCRIPTION OF THE DRAWINGS

The foregoing, features and advantage of the present invention will become fully understanding through the detailed description with the accompany drawing.

DESCRIPTION OF THE PREFERRED EMBODIMENT

The invention will now be described in greater detail with preferred embodiments of the invention and illustrations attached. Nevertheless, it should be recognized that the preferred embodiments of the invention is only for illustrating. Besides the preferred embodiment mentioned here, present invention can be practiced in a wide range of other embodiments besides those explicitly described, and the scope of the present invention is expressly not limited expect as specified in the accompanying claims.

Figure 1:
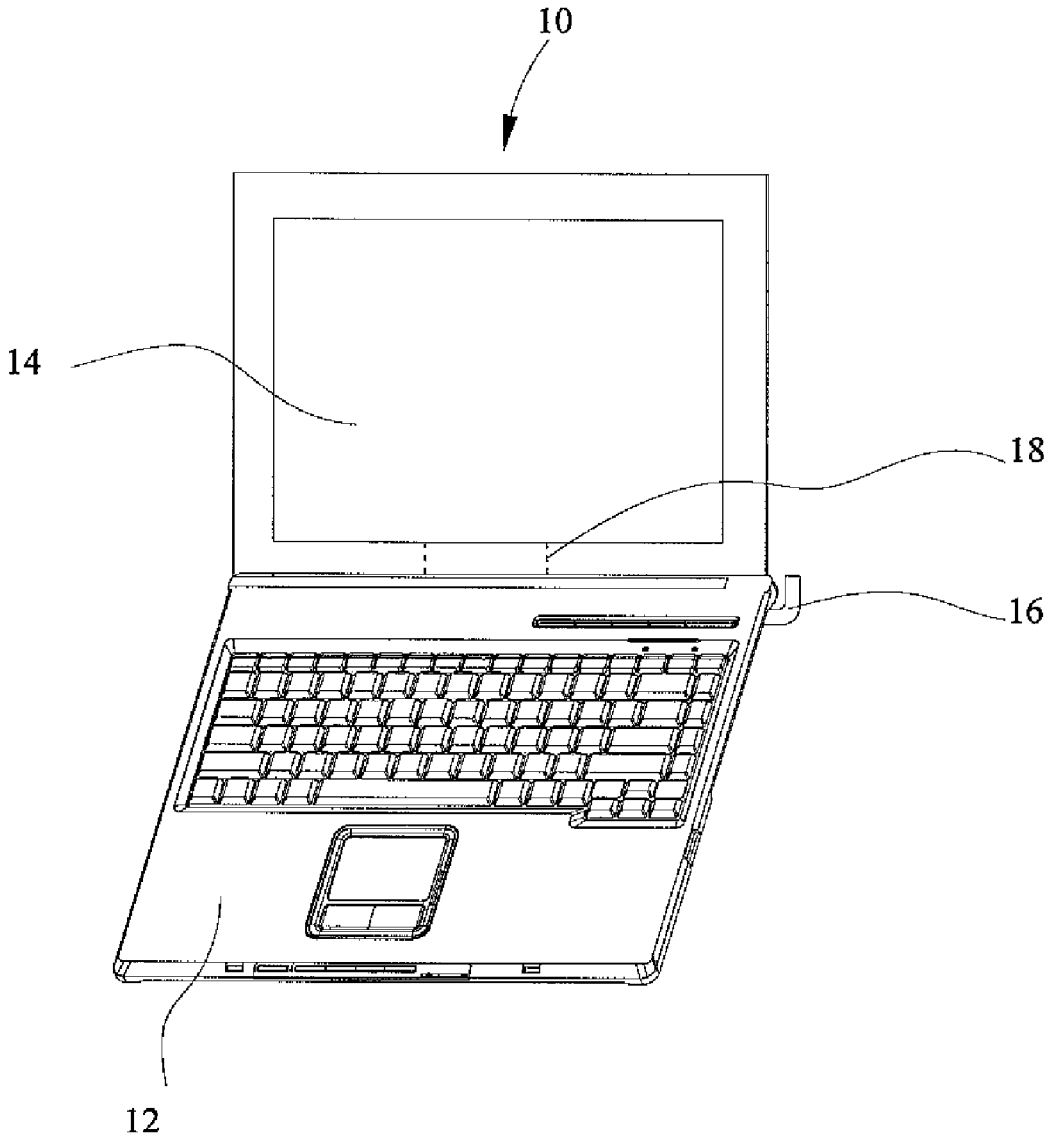
FIG. 1 is a diagram illustrating a conventional embodiment of antennas configuration for a laptop.
Figure 2:
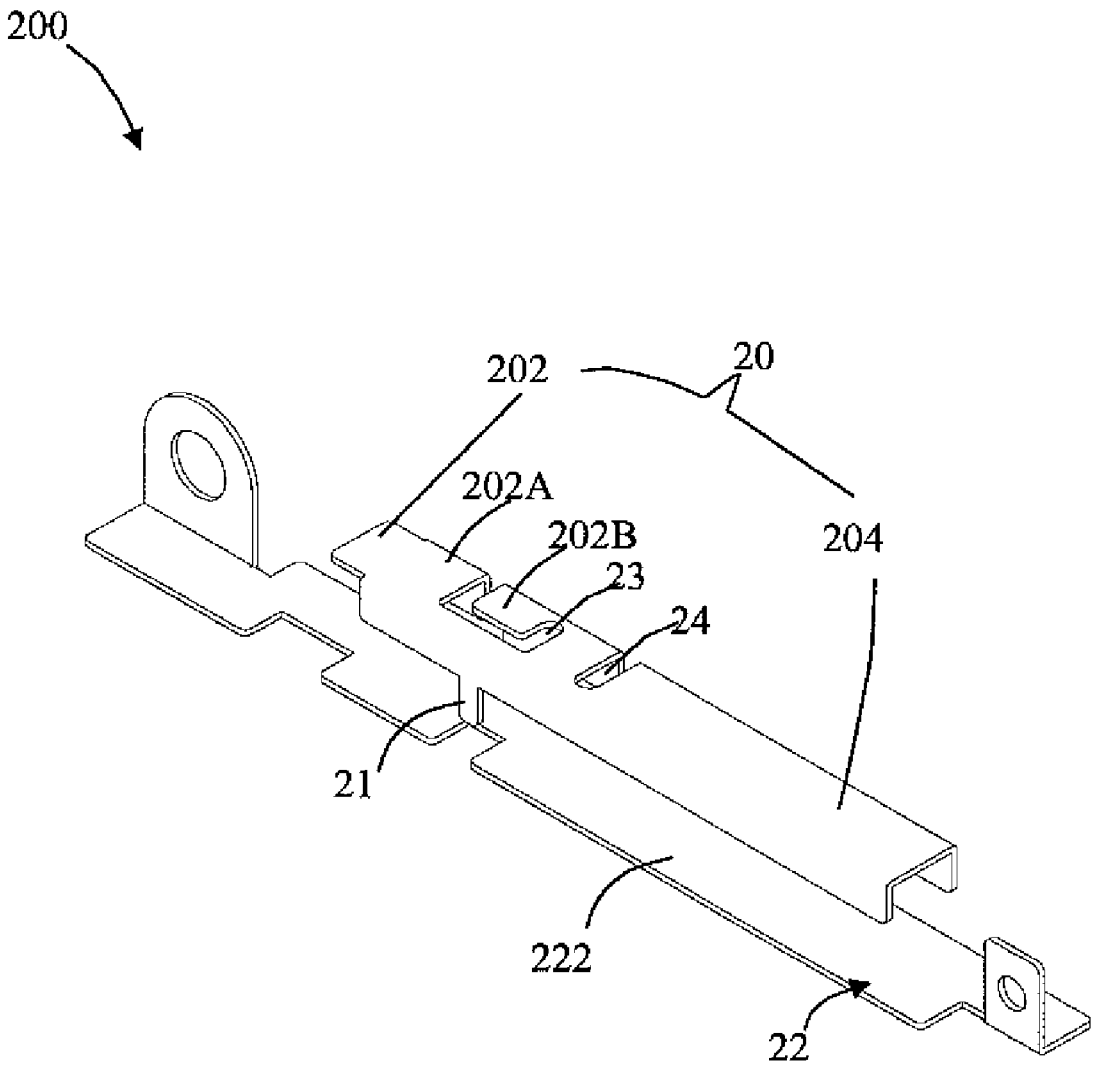
FIG. 2 is a diagram illustrating a perspective view of an embedded antenna according to the present invention.

FIG. 2 illustrates a perspective view of an embedded antenna in accordance with one embodiment of the present invention. The embedded antenna of the present invention is a planar inverted F antenna (PIFA) that has a specific design to extend the low and high band for improving the performance of the antenna so that the present invention can be broadly operated in various protocols and configurations. As shown in FIG. 2, the embedded antenna 200 of the present invention comprises a radiating element 20, a feeding point 21, and a grounding element 22. The radiating element 20 includes a first radiating element 202, a second radiating element 204, wherein the two elements may be operated at a different frequency band respectively. The radiating element 20 may emit radiation when current is fed into the embedded antenna 200 through the feeding point 21. The grounding element 22 includes a first grounding plane 222 and a second grounding plane 224, wherein the first grounding plane 222 is orthogonal to the second grounding plane as shown in FIG. 2.

Figure 3:
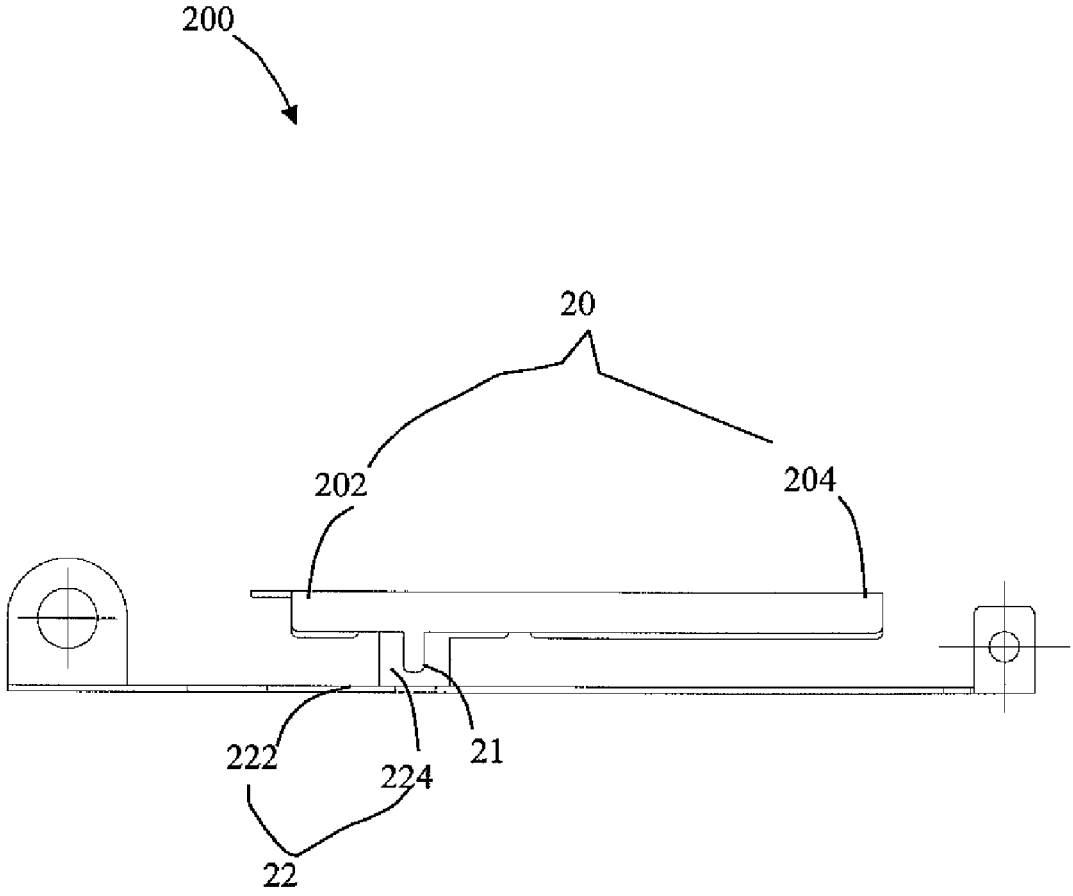
FIG. 3 is a diagram illustrating a front view of the embedded antenna according to the present invention.

Referring to FIG. 2 and FIG. 3, the grounding element 22 extends upwardly to electrically connect with the radiating element 20. A feeding point 21 also extends upwardly to electrically connect to the radiating element 20. A feed line (not shown) electrically connects to the feeding point 21 for feeding current into the embedded antenna 200. By the usage of the feeding point 21, the current from the feed-line may cause the radiation emitted from the radiating elements, for instant, to receive or transmit the RF signal in IEEE 802.11b/g (2.4-2.5 GHz) or IEEE 802.11a (4.9-5.85 GHz). The table 1 shows the average gains at different corresponding frequencies of the embedded antenna 200.

TABLE 1

| Frequency (Hz) | Average Gain (dBi) | Peak Gain (dBi) |
|---|---|---|
| 2400 | −2.79 | 2.34 |
| 2450 | −2.69 | 1.57 |
| 2500 | −3.46 | 1.77 |
| 4900 | −3.49 | 1.15 |
| 5150 | −4.23 | −0.28 |
| 5350 | −2.43 | 2.55 |
| 5470 | −3.08 | 1.48 |
| 5650 | −4.40 | −1.03 |
| 5730 | −3.71 | 0.51 |
| 5750 | −3.72 | 0.23 |
| 5830 | −3.81 | 0.69 |
| 5900 | −3.72 | −0.49 |

Preferably, the cross-section of the radiating element 20 shows an inverted U-shaped section having a feeding point 21 that is formed on the upper plane of the inverted U-shaped structure thereby defining or forming the first radiating element 202 and the second radiating element 204. The first radiating element 202 stands for the high-band radiating element in the embedded antenna 200, preferably, the frequency band is correspondent to IEEE 802.11a (4.9-5.85 GHz). Accordingly, the second radiating element 204 indicates the low-band radiating element, the band of which is corresponding to IEEE 802.11b/g (2.4-2.5 GHz). The first radiating element 202 and the second radiating element 204 have a first resonant length and a second resonant length respectively, used for determining the band at which the radiating element operates, and the second resonant length is longer than the first resonant length.

The meander groove 23, especially to be U-shaped groove, divides the high-band radiating element 202 of the radiating element 20 into two smaller areas 202A and 202B, therefore, the resonant length (the first resonant length) of high frequency band is divided into two smaller paths. Additionally, a meander groove 24 is formed on low-band radiating element 204. The area 202B is extended upwardly and perpendicular to the second grounding plane 224. The bandwidth at which embedded antenna 200 operates in high frequency band is respectively divided into two part correspond to the areas 202A and 202B because the resonant length of the first radiating element 202 is divided. The bandwidths corresponding to the areas 202A and 202B are partially overlapped to generate wider bandwidth of the radiating element 20 compare with the bandwidth of a conventional antenna.

Figure 6:
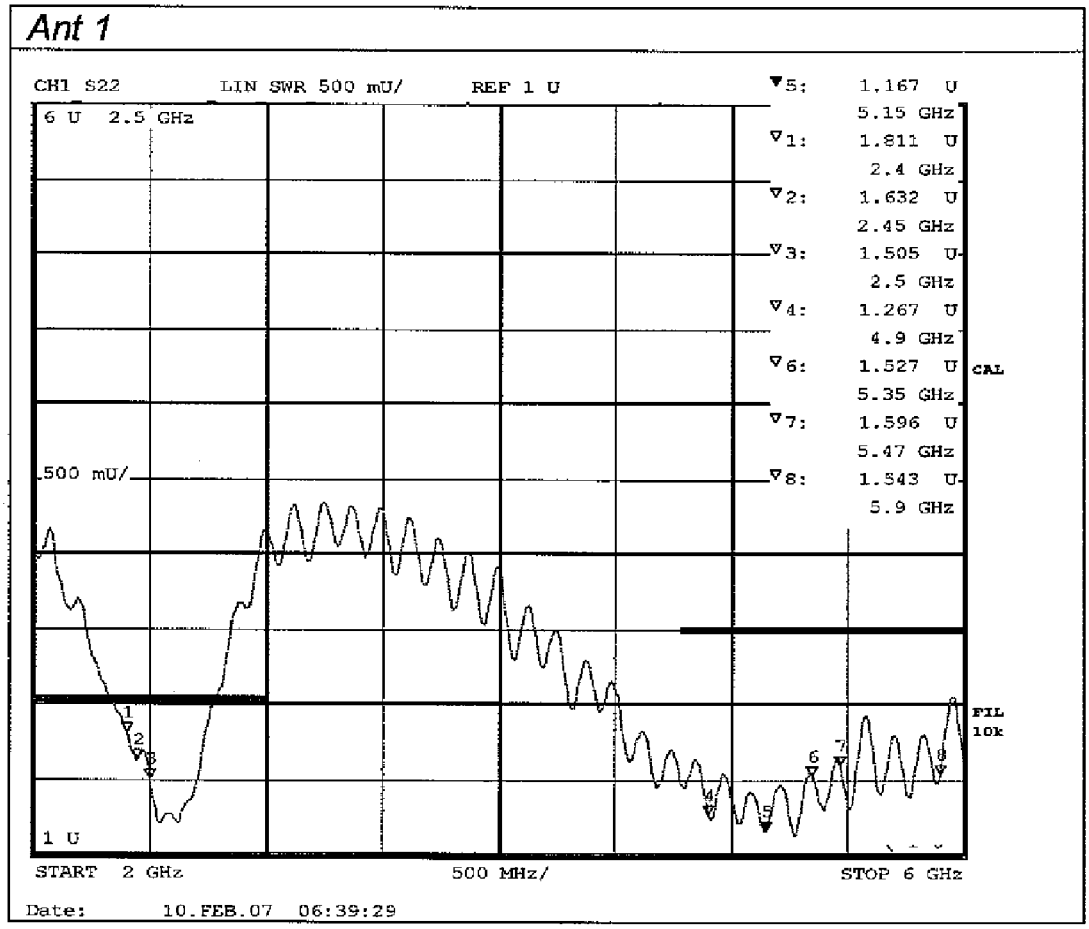
FIG. 6 illustrates the measured SWR (standing wave ratio) of the embedded antenna of FIG. 2 as a function of frequency in two frequency bands.

Preferably, the physical length of the radiating element 204 (the low-band radiating element) of the radiating element 20 is extended by the meander groove 24 to achieve the purpose. When the physical length is increased, the resonant length of the radiating element 204 is increased accordingly so that the bandwidth of the low band is wider. For the foregoing, the design of the embedded antenna 200 could extend high-band and low-band bandwidths, and it has more excellent performance to accommodate with various communication protocols and configurations. Preferably, the embedded antenna of the present invention is mounted on an electronic device through the first grounding plane, wherein the electronic device includes a personal computer, a cellular telephone, a portable computer, a PDA or a similar device. FIG. 6 illustrates the measured SWR (standing wave ratio) of the embedded antenna 200 as a function of frequency in two frequency bands.

Figure 4:
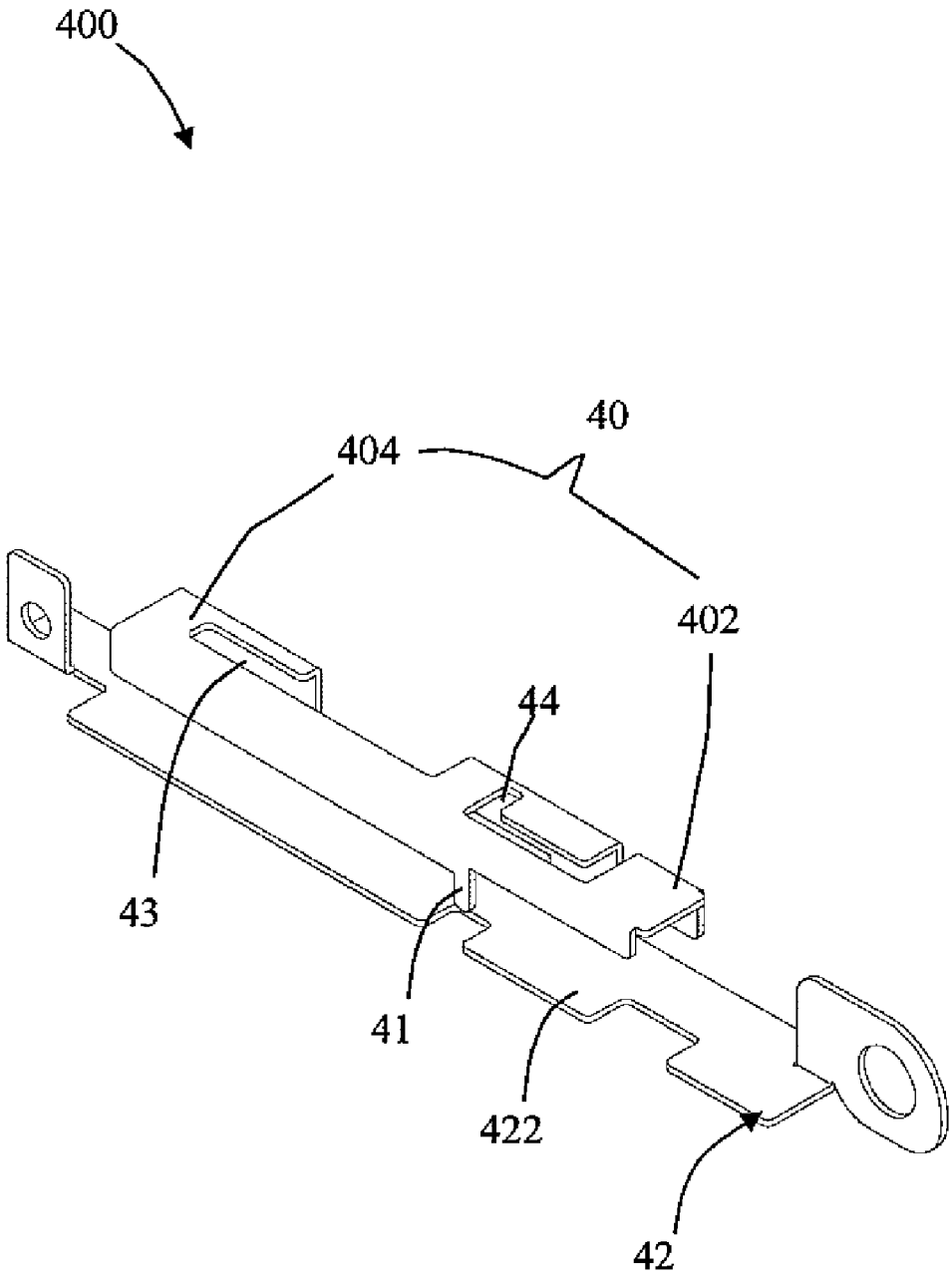
FIG. 4 is a diagram illustrating a perspective view of the embedded antenna according to another embodiment of present invention.
Figure 5:
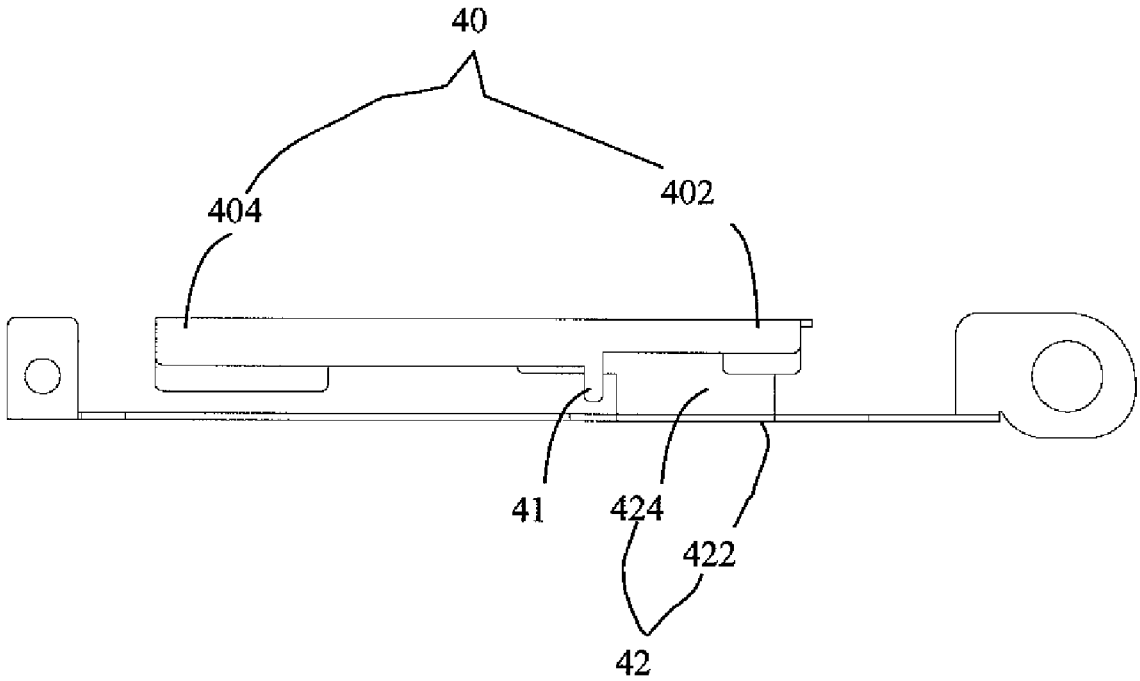
FIG. 5 is a diagram illustrating a front view of the embedded antenna according to another embodiment of the present invention.

In another embodiment, FIG. 4 illustrates a perspective view of the embedded antenna 400 according to the present invention. Referring to FIG. 4 and FIG. 5, the embedded antenna 400 of the present invention comprises a radiating element 40, a feeding point 41, and a grounding element 42. The radiating element 40 includes a first radiating element 202, a second radiating element 204, wherein the two elements have a different frequency band respectively. The first radiating element 402 stands for the high-band radiating element in the embedded antenna 400, preferably, the band is corresponding to IEEE 802.11a (4.9-5.85 GHz). Accordingly, the second radiating element 404 stands for the low-band radiating element the band of which corresponding IEEE 802.11b/g (2.4-2.5 GHz). When current is fed into the embedded antenna 400 through the feeding point 41, the radiating element 40 may emit radiation due to the EM oscillation. As aforementioned, the first grounding plane 422 is orthogonal with the second grounding plane 424.

The structure of the embedded antenna 400 is similar to the structure of the embedded antenna 200, therefore, the similar portion, such as the description of meander groove 44 is omitted. Table 2 shows the average gains at different frequencies.

TABLE 2

| Frequency (Hz) | Average Gain (dBi) | Peak Gain (dBi) |
|---|---|---|
| 2400 | −4.65 | 0.35 |
| 2450 | −4.50 | −0.33 |
| 2500 | −4.98 | −0.84 |
| 4900 | −4.34 | −0.23 |
| 5150 | −4.18 | 1.00 |
| 5350 | −4.02 | 0.57 |
| 5470 | −3.82 | 0.06 |
| 5650 | −4.18 | 0.29 |
| 5730 | −4.00 | −0.06 |
| 5750 | −3.98 | −0.29 |
| 5830 | −4.30 | −0.41 |
| 5900 | −5.31 | −1.11 |

Preferably, a meander groove 43, especially to be U-shaped groove, which extends the resonant length of the high-band/low-band radiating element of radiating element 40 is formed at the first/second radiating element 402/404. This decreases the size of the embedded antenna 400 and achieves a broader bandwidth at low band.

For the above-mentioned, the embedded antenna 400 of the present invention broadens the bandwidths of the high band and the low band, which has more excellent performance and smaller size to accommodate with various communication protocols and configurations.

Figure 7:
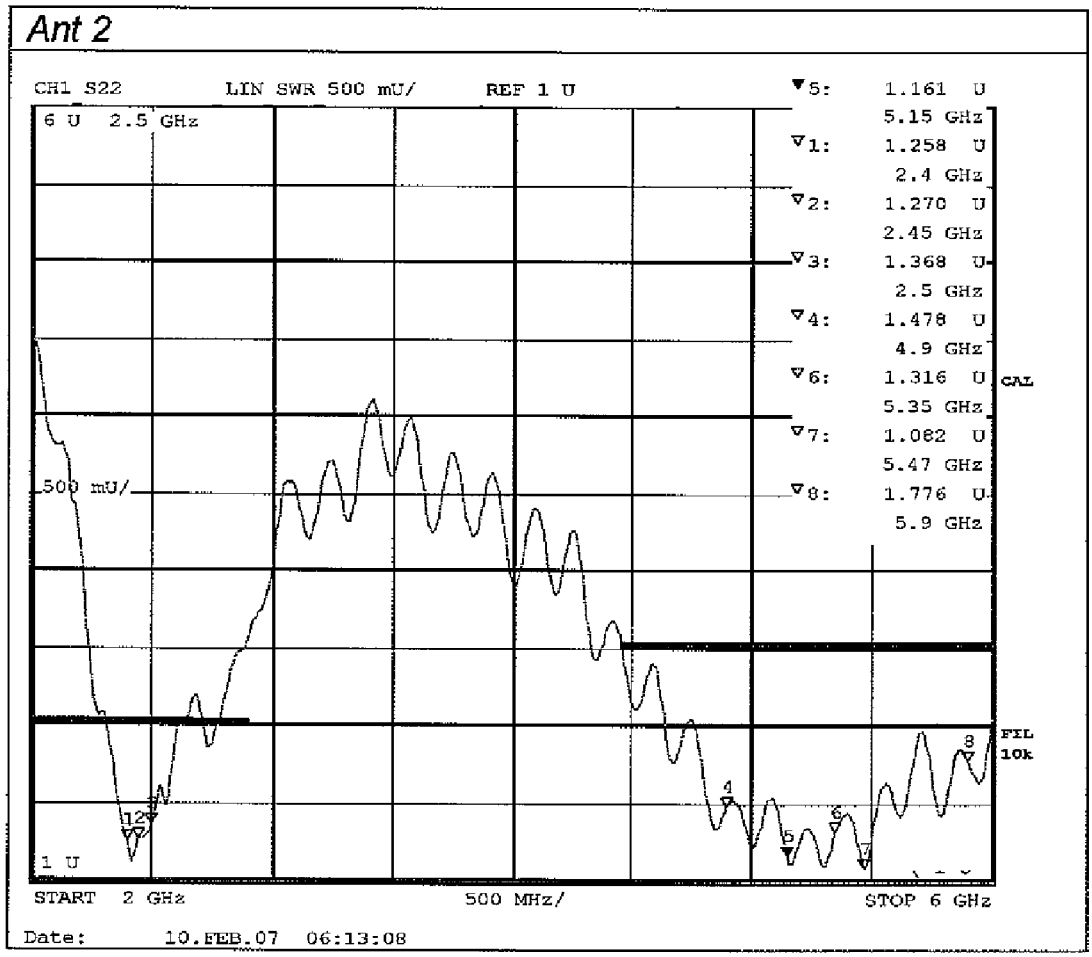
FIG. 7 illustrates the measured SWR (standing wave ratio) of the embedded antenna of FIG. 4 as a function of frequency in two frequency bands.
Figure 8:
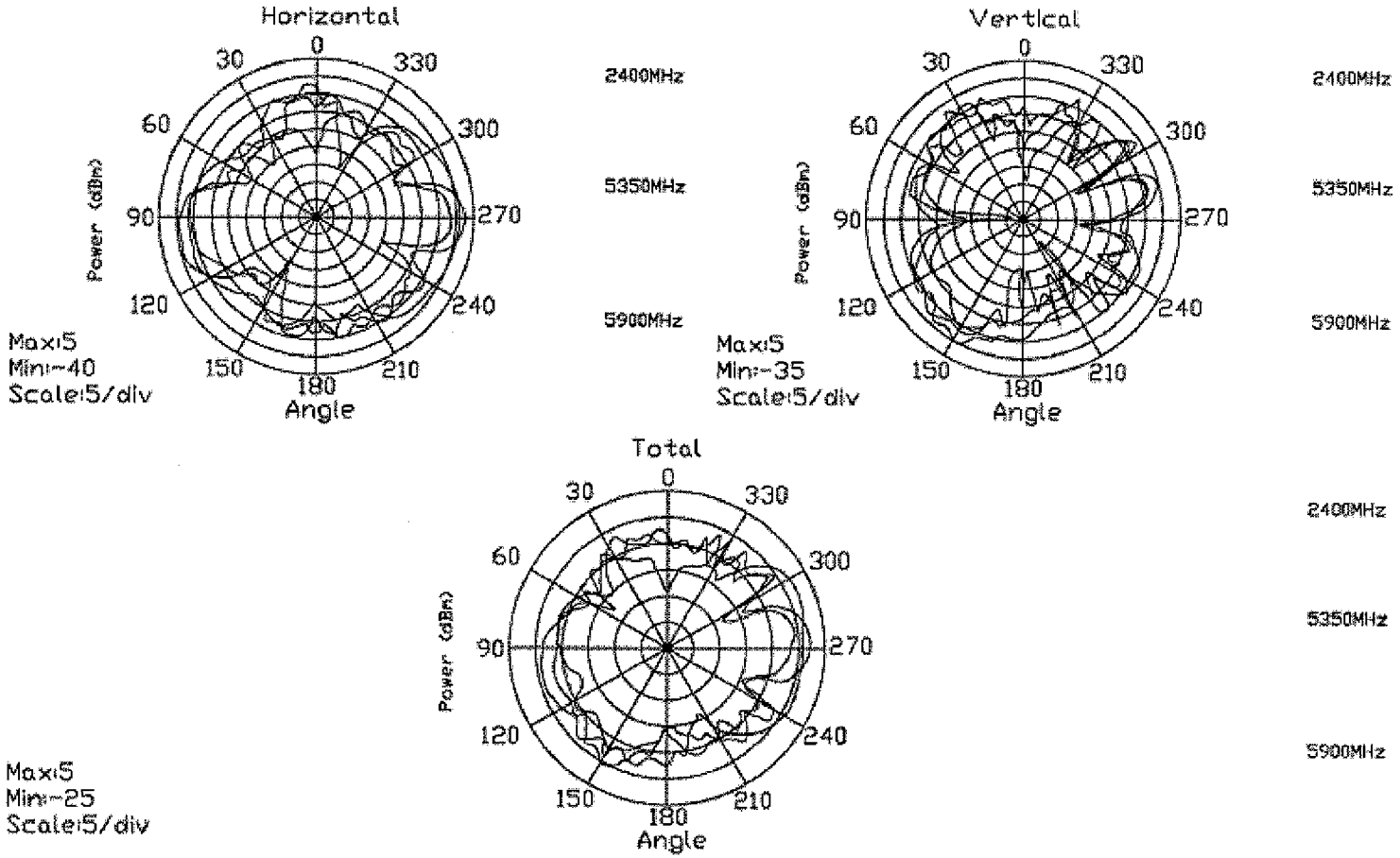
FIG. 8 is graphical diagrams illustrating the measured radiation pattern of the embedded antenna of FIG. 2 at various frequencies.
Figure 9:
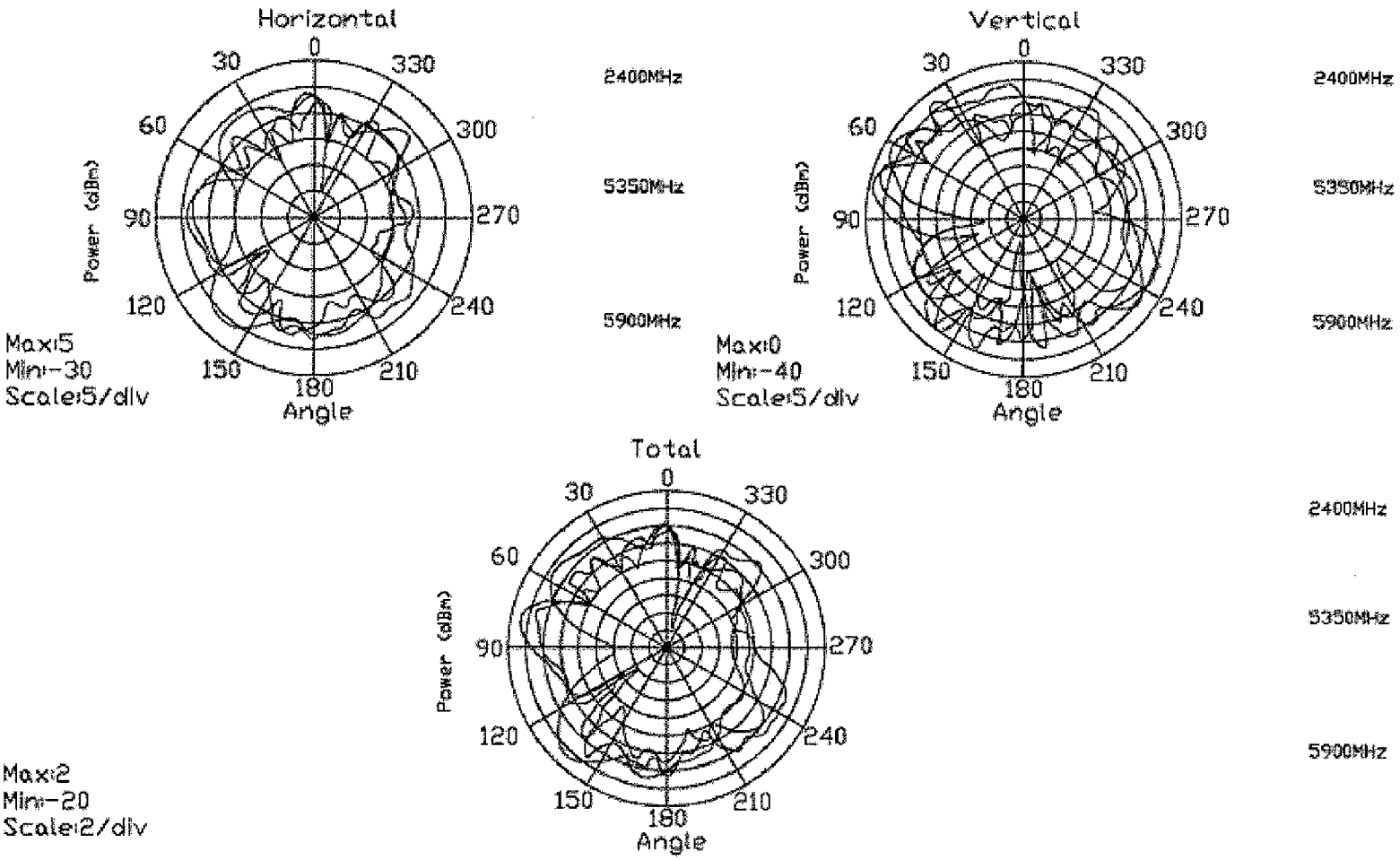
FIG. 9 is graphical diagrams illustrating the measured radiation pattern of the embedded antenna of FIG. 4 at various frequencies.

FIG. 7 illustrates the measured SWR (standing wave ratio) of the embedded antenna 400 as a function of frequency at two frequency bands. Thus, the embedded antenna has good performance than the conventional antenna. Additionally, FIG. 8 and FIG. 9 illustrate respectively the measured radiation patterns of the embedded antennas 200 and 400 at various frequencies.

Although preferred embodiments of the present invention have been described, it will be understood by those skilled in the art that the present invention should not be limited to the described preferred embodiments. Rather, various changes and modifications can be made within the spirit and scope of the present invention, as defined by the following claims.

Having described the invention, the following is claimed:

1. An embedded antenna, comprising:

a grounding element having a first ground plane and a second ground plane;

a first radiating element connected to said grounding element, operating at a first frequency band and having a first resonant length, wherein said first radiating element having a first meander formed thereon dividing the first resonant length into at least two resonant lengths thereby extending the first frequency band, wherein said radiating element has a first plane extended from said second grounding plane;

a second radiating element connected to said grounding element, operating at a second frequency band and having a second resonant length; and a feeding point connected to said first radiating element and said second radiating element.

2. The antenna of claim 1, wherein said first grounding plane and said second grounding plane are in a perpendicular position.

3. The antenna of claim 1, wherein said second resonant length is longer than said first resonant length.

4. The antenna of claim 1, wherein said first frequency band is about 4.9 GHz to 5.85 GHz.

5. The antenna of claim 1, wherein said second frequency band is about 2.4 GHz to 2.5 GHz.

6. The antenna of claim 1, wherein said embedded antenna includes a planar inverted F antenna (PIFA).

7. The antenna of claim 1, wherein said embedded antenna is mounted on an electronic device through said first grounding plane.

8. The antenna of claim 7, wherein said electronic device includes a personal computer, a cellular telephone, a portable computer, a PDA or a similar device.

9. An embedded antenna, comprising:

a grounding element having a first ground plane and a second ground plane;

a first radiating element connected to said grounding element, operating at a first frequency band and having a first resonant length, wherein said first radiating element having a first meander formed thereon dividing the first resonant length into at least two resonant lengths thereby extending the first frequency band, wherein said radiating element has a first plane extended from said second grounding plane;

a second radiating element connected to said grounding element, operating at a second frequency band and having a second resonant length, wherein said second radiating element has a second meander thereby extending the second resonant length; and a feeding point connected to said first radiating element and said second radiating element.

10. The antenna of claim 9, wherein said first grounding plane and said second grounding plane are in a perpendicular position.

11. The antenna of claim 9, wherein said second resonant length is longer than said first resonant length.

12. The antenna of claim 9, wherein said first frequency band is about 4.9 GHz to 5.85 GHz.

13. The antenna of claim 9, wherein said second frequency band is about 2.4 GHz to 2.5 GHz.

14. The antenna of claim 9, wherein said embedded antenna includes a planar inverted F antenna.

15. The antenna of claim 9, wherein said embedded antenna is mounted on an electronic device through said first grounding plane.

16. The antenna of claim 15, wherein said electronic device includes a personal computer, cellular telephone, portable computer, PDA or similar device.

* * * * *